US005530530A

United States Patent [19]

Tanaka et al.

[11] Patent Number: 5,530,530

[45] Date of Patent: Jun. 25, 1996

[54] APPARATUS FOR MEASURING DEVELOPER DENSITY

[75] Inventors: Masaki Tanaka, Toyohashi; Atsushi Kawai, Aichi-Ken; Tetsuya Sakai, Toyokawa; Naoyoshi Kinoshita, Aichi-Ken; Yukihiko Okuno, Toyokawa, all of Japan

[73] Assignee: Minolta Co., Ltd., Osaka, Japan

[21] Appl. No.: 435,813

[22] Filed: May 5, 1995

[30] Foreign Application Priority Data

May 10, 1994 [JP] Japan ..... 6-096242
Mar. 13, 1995 [JP] Japan ..... 7-052679

[51] Int. Cl.[6] ..... G03G 21/00

[52] U.S. Cl. ..... 355/246; 118/653; 355/203; 355/208

[58] Field of Search ..... 355/203, 204, 355/208, 245, 246, 260; 118/653

[56] References Cited

U.S. PATENT DOCUMENTS 5,117,259 5/1992 Etou et al. ..... 355/203
5,216,469 6/1993 Yamada ..... 355/246
5,270,784 12/1993 Nakane et al. ..... 355/246
5,276,481 1/1994 Kinoshita et al. ..... 355/246 X
5,285,243 2/1994 Ramai et al. ..... 355/246
5,383,007 1/1995 Kinoshita et al. ..... 355/246
5,398,106 3/1995 Eguchi ..... 355/260

*Primary Examiner*—Sandra L. Brase
*Attorney, Agent, or Firm*—Burns, Doane, Swecker & Mathis

[57] ABSTRACT

Developer density measuring apparatus comprising a transparent detection window confronting the interior of a developing device, illumination means for illuminating developer comprising a toner and a carrier accommodated in said developing device, and density determining means for determining developer density by the amount of light reflected from said developer measured through said transparent detection window, and wherein the surface of the transparent detection window on the side confronting the interior of the developing device is roughened.

13 Claims, 8 Drawing Sheets

APPARATUS FOR MEASURING DEVELOPER DENSITY

BACKGROUND OF THE INVENTION

Field of the Invention

The present invention relates to an apparatus for measuring developer density, and specifically relates to an apparatus for measuring developer density provided with a transparent detection window confronting the interior of a developing device, which measures density of a developer by detecting the amount of light reflected from a developer through said transparent detection window.

Description of the Related Art

In image forming apparatus such as copiers, printers and the like using two-component developers comprising a toner and a carrier, the toner and carrier accommodated in the developing device are mixed, to as to be charged and circulated within the developing device. At a position opposite the photosensitive member, charged toner adheres to an electrostatic latent image formed on the surface of a photosensitive member, thereby developing said latent image.

At this time, the carrier is maintained in an almost constant amount because it is not supplied for developing and only the toner is transported. In contrast, toner is gradually depleted due to consumption in the developing process, such that the density of the developer accommodated in the developing device, i.e., the toner weight mix ratio relative to the carrier, is gradually reduced.

Accordingly, in order to maintain a suitable developer density it becomes necessary to measure the density of the developer within the developing device and replenish a suitable amount of toner in accordance with the measurement results. Thus, various devices have been proposed for measuring the density of a developer accommodated in a developing device.

For example, U.S. Pat. Nos. 5,117,259 and 5,383,007 disclose devices for measuring developer density by optical means.

The aforesaid devices illuminate the developer accommodated in a developing device through a transparent detection window confronting the interior of the developing device, measure the amount of light reflected from the developer through said transparent detection window via an optical sensor or the like, and determine the density of the developer via said measured amount of reflected light. In contrast to the carrier which absorbs light, toner has the characteristics of reflecting light, such that the amount of light reflected from the developer is greater as the developer density increases (i.e., the toner content is higher), and said amount of reflected light is less as the developer density decreases (i.e., the toner content is lower).

In the aforesaid devices, an electrically conductive layer is provided on the surface of the transparent detection window on the side confronting the interior of the developing device, so as to apply a bias voltage having the same polarity as the toner charge polarity to said electrically conductive layer. The aforesaid bias voltage is applied in order to prevent accurate density measurement from being impossible due to the light reflected by the charged toner which electrostatically adheres to the surface of the transparent detection window In the aforesaid devices, there are times when accurate developer density measurement cannot be accomplished due to the condition of the transparent detection window.

Since the transparent detection window is confronting the inside of the developing device, the surface of the window is unavoidably subject to friction-induced flaws due to rubbing on the window of the toner circulating within the developing device. Friction-induced flaws cause scattering of the reflected light, and the extent of said flows increases as developing is repeated, such that the amount of reflected light measured through the transparent detection window is reduced without correlation to the actual developer density to the extent that accurate density measurement becomes no longer possible.

On the other hand, when an electrically conductive layer is provided on the surface of the transparent detection window such as the aforesaid devices, the electrically conductive layer is scraped off by the rubbing of the developer, such that the bias voltage is no longer suppliable. Conductive layers formed on the surface of the transparent detection window, for example, by vapor deposition of indium oxide, titanium oxide or the like, are subject to wear via rubbing by the developer. When wear of the conductive layer progresses such that the layer is scraped off and the bias voltage is no longer suppliable, charged toner electrostatically adheres to the surface of the transparent detection window so as to prevent accurate density measurement as previously described. Furthermore, transparent detection windows provided with a conductive layer require periodic replacement, thereby increasing the maintenance cost.

SUMMARY OF THE INVENTION

In view of the previously described disadvantages, an object of the present invention is to provide a developer density measuring apparatus capable of accurate and stable density measurement by reducing the effects of friction-induced flaws on the surface of the transparent detection window due to rubbing of the developer.

Another object of the present invention is to provide developer density measuring apparatus capable of accurate and stable density measurement by preventing wear of the conductive layer on the transparent detection window due to rubbing of the developer. The present invention further provides a developer density measuring apparatus which, by virtue of the aforesaid objects, either extends the replacement period of the transparent detection window having a conductive layer or does not require replacement.

The aforesaid first object is achieved by providing a developer density measuring apparatus comprising a transparent detection window confronting the inside of a developing device, illumination means for illuminating developer comprising a toner and a carrier accommodated in said developing device, and density determining means for determining developer density by the amount of light reflected from said developer measured through said transparent detection window, and wherein the surface of the transparent detection window on the side confronting the inside of the developing device is roughened.

The aforesaid second object is achieved by providing a developer density measuring apparatus comprising a transparent detection window confronting the inside of a developing device, illumination means for illuminating developer comprising a toner and a carrier accommodated in said developing device, density determining means for determining developer density by the amount of light reflected from said developer measured through said transparent detection window, electrically conductive layer provided on the surface of said transparent detection window on the side confronting the interior of the developing device, and bias supplying means to supply a bias voltage having the same polarity as the toner charge polarity to said electrically conductive layer, and wherein a dielectric layer is provided on the electrically conductive layer of said transparent detection window.

According to the aforesaid first developer density measuring apparatus, it is difficult to produce new flaws in the surface of the transparent detection window even when rubbed by developer, and the amount of measured reflected light does not change greatly even when flaws are produced on said surface. Thus, accurate and stable developer density measurement is possible.

According to the aforesaid second developer density measuring apparatus, there is no wearing of the electrically conductive layer even when rubbed by the developer. Thus, accurate and stable developer density measurement is possible, and the replacement period of the transparent detection window is prolonged or such replacement is not required, thereby decreasing the maintenance cost.

BRIEF DESCRIPTION OF THE DRAWINGS

These and other objects and features of the present invention will become apparent from the following description taken in conjunction with the preferred embodiments thereof with reference to the accompanying drawings.

Figure 5:
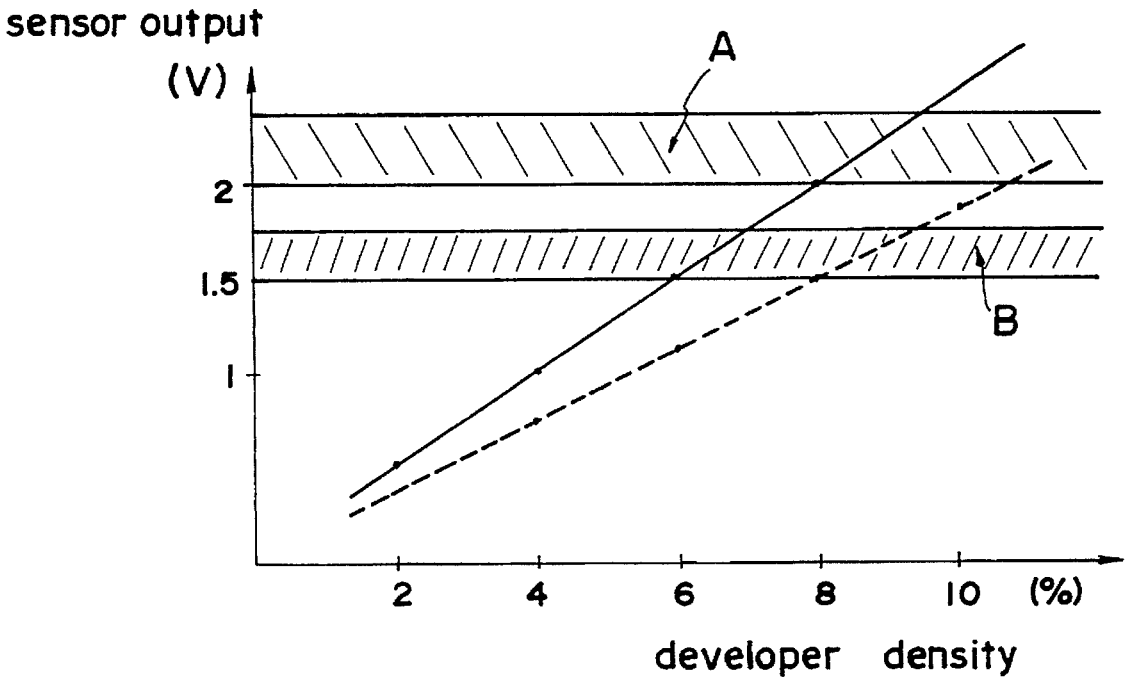
Figure 6:
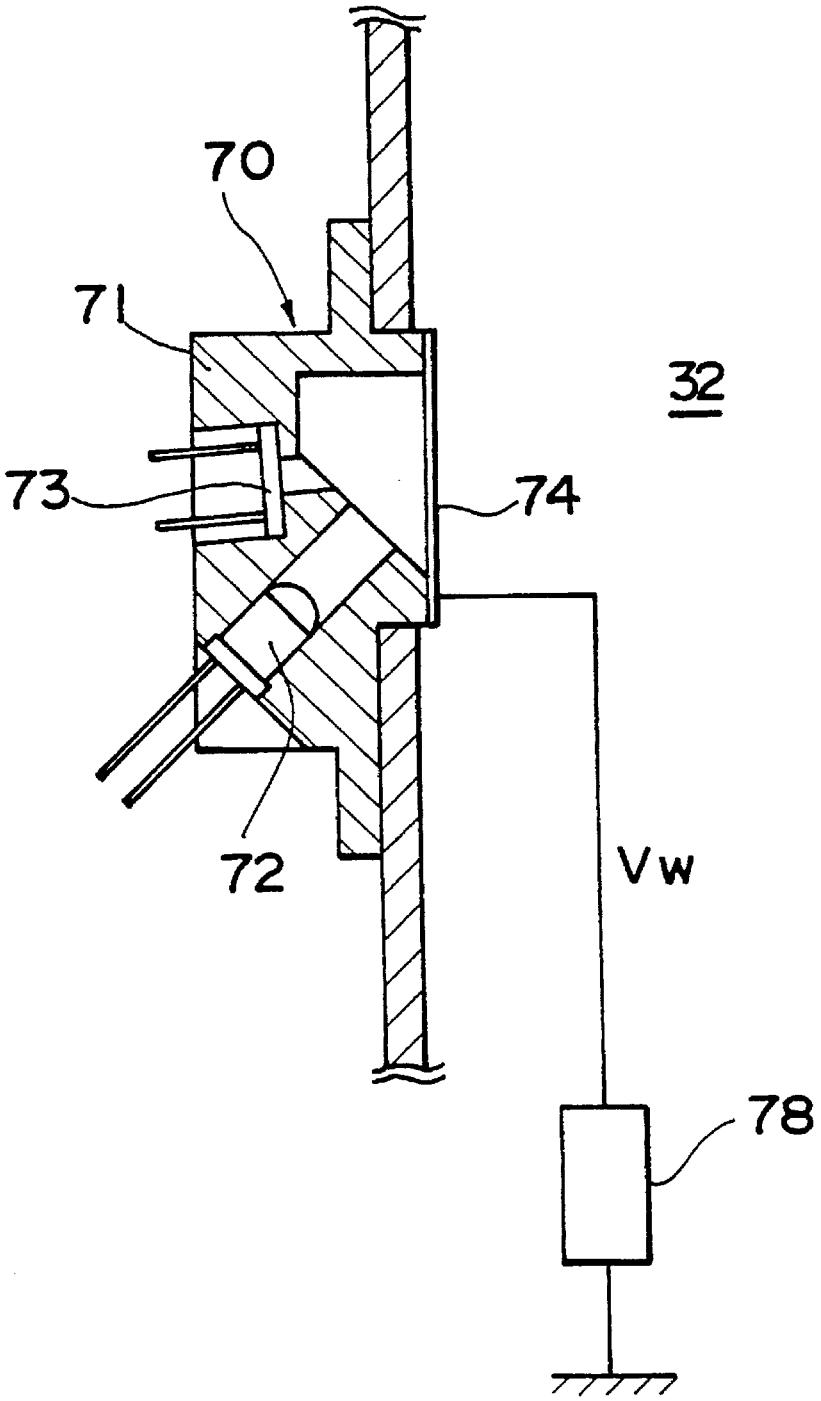
Figure 7:
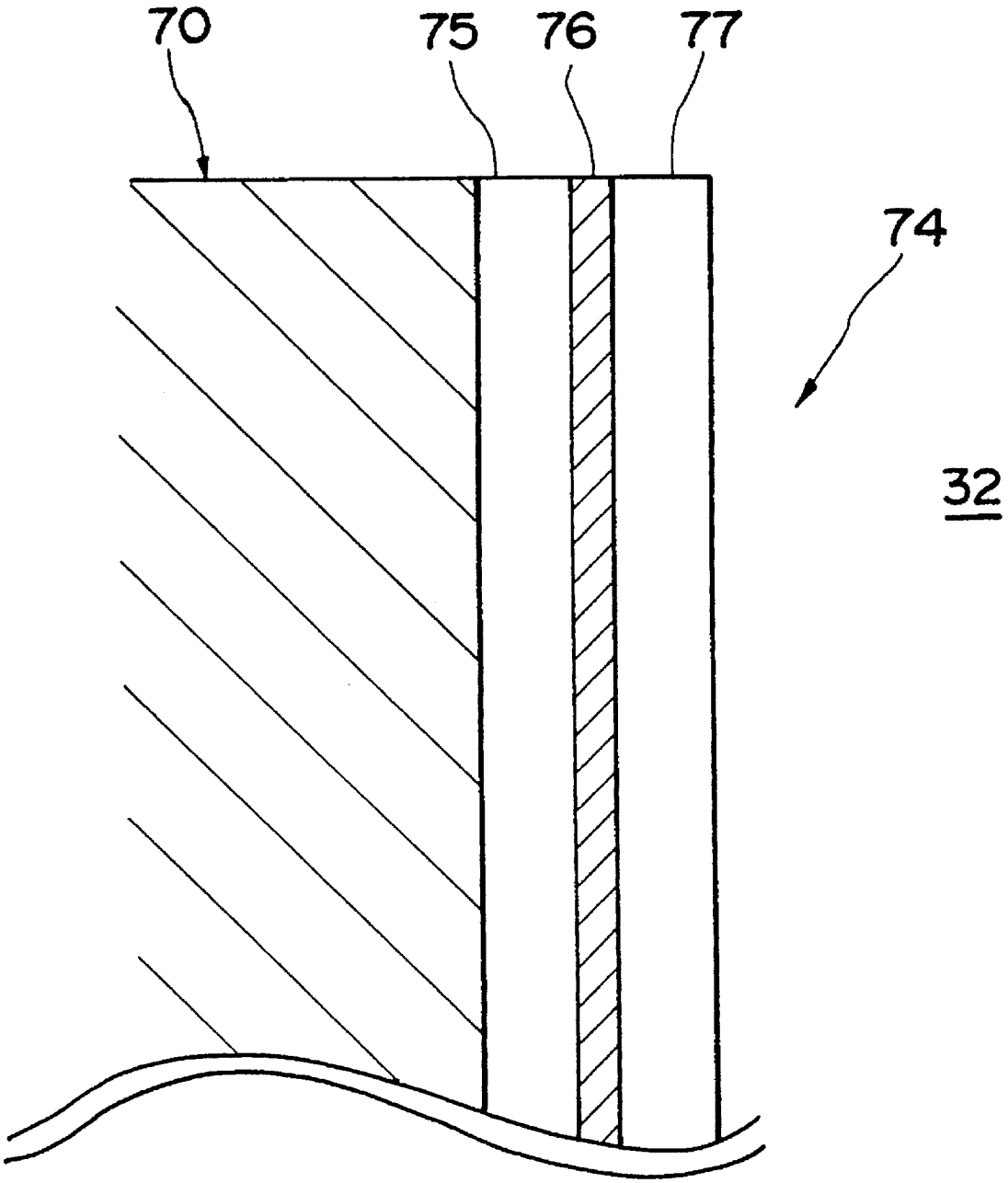

FIG. *4a* is a graph showing the change in output of a conventional sensor using a smooth flat-surfaced transparent detection window;

FIG. *4b* is a graph showing the change in output of a sensor when the surface of a transparent detection window is regularly roughened at uniform spacing;

FIG. *4c* is a graph showing the change in output of developer density measuring sensor 50;

FIG. 5 is a graph showing the relationship between developer density and sensor output;

FIG. 6 is a section view of developer density measuring sensor 70;

FIG. 7 is a section view showing the construction of transparent detection window 74 of developer density measuring sensor 70;

FIG. *8a* is a graph showing the change in output of a conventional sensor wherein a conductive layer coating is provided on the surface of the transparent detection window;

FIG. *8b* is a graph showing the change in output of developer density measuring sensor 70.

DETAILED DESCRIPTION OF THE PREFERRED EMBODIMENTS

First Embodiment

A first embodiment of the present invention is described hereinafter with reference to the accompanying drawings.

1) Construction

Figure 1:
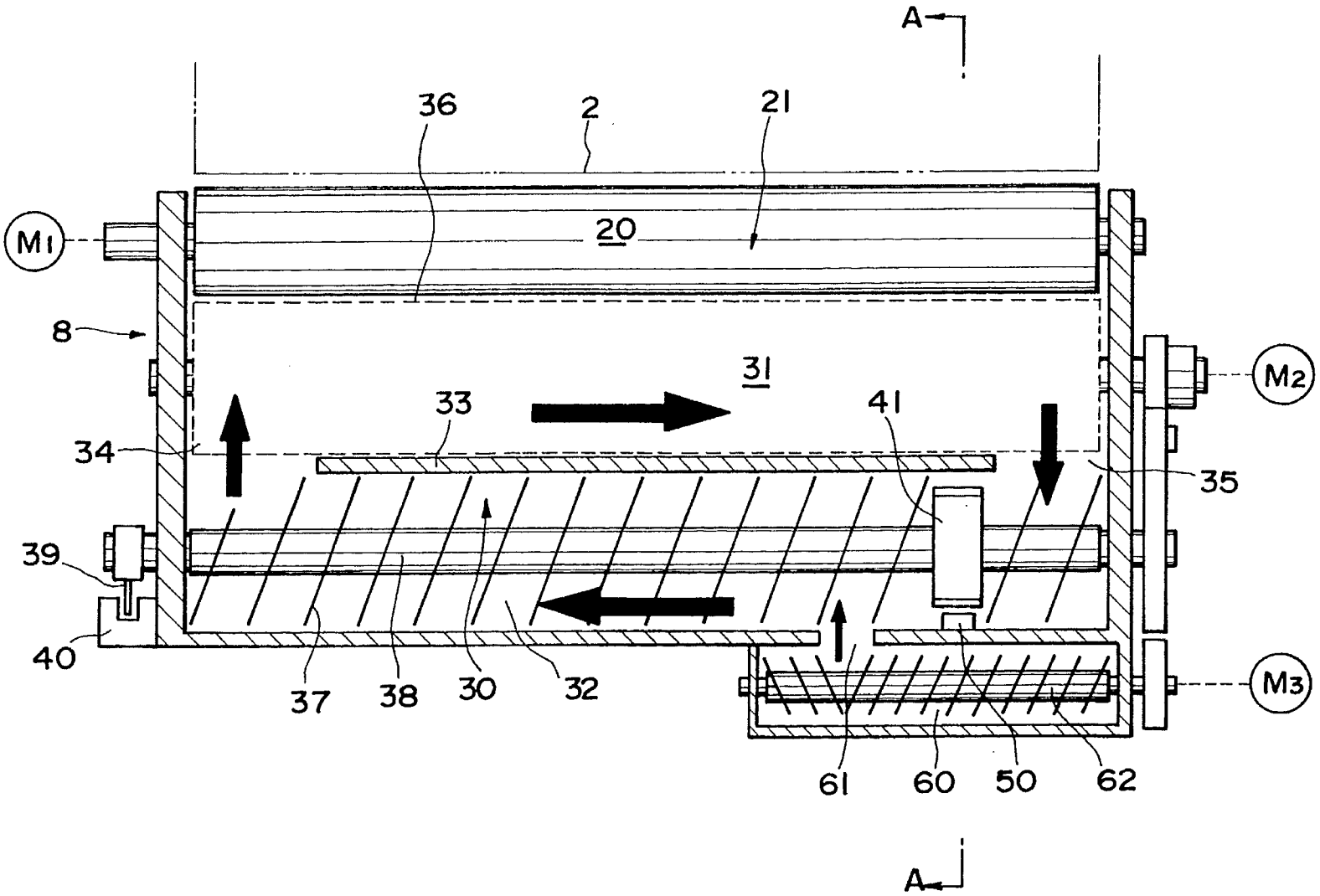
FIG. 1 is a horizontal section view of developing device 8.
Figure 2:
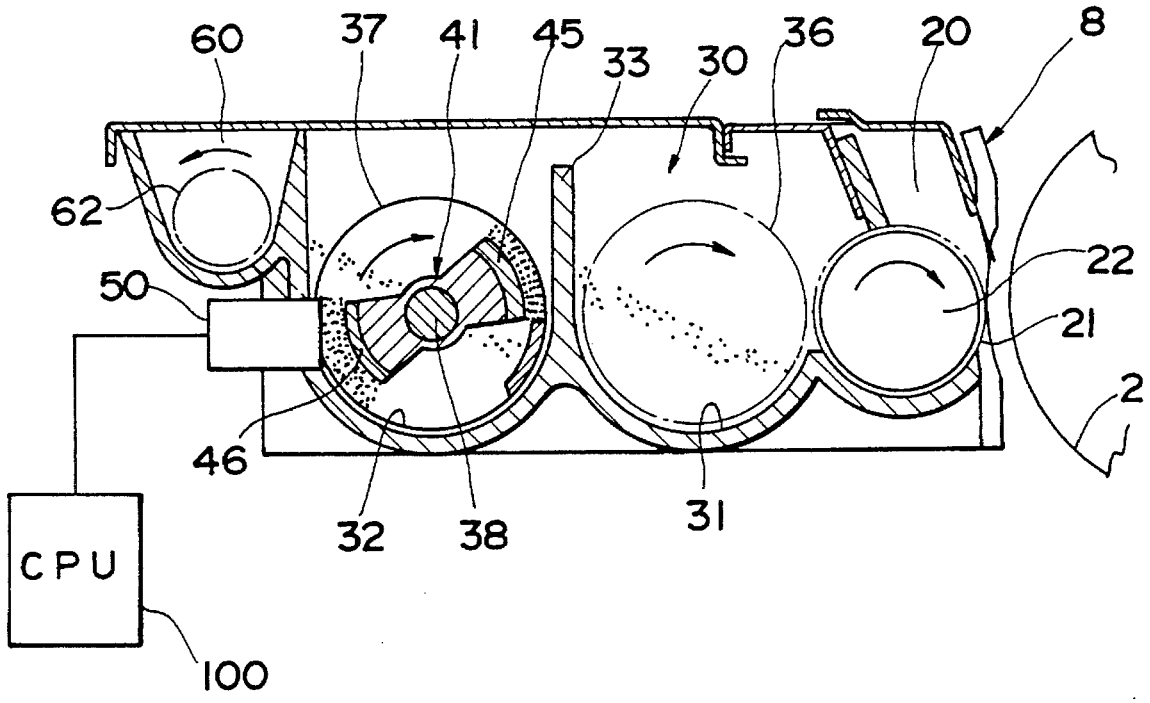
FIG. 2 is a section view on the A—A plane of developing device 8.

FIGS. 1 and 2 are section views of developing device 8 of a copying machine of an electrophotographic type. Developing device 8 comprises the three parts of developing unit 20, mixing unit 30, and replenishing unit 60.

The electrophotographic copying apparatus provided with developing device 8 has a well known construction such as that disclosed in U.S. Pat. No. 5,383,007. Developing device 8 is not only suitable for copying apparatus, but is also suitable for general image forming apparatus of electrophotographic types including electrophotographic printers and the like.

(1) Developing unit 20

Developing unit 20 is positioned opposite photoconductive member 2, and houses sleeve roller 21. Sleeve roller 21 is driven by motor M1 so as to rotate in the direction indicated by the arrow in FIG. 2. Magnetic roller 22 is housed within sleeve roller 21 in a stationary, non-rotating state.

(2) Mixing unit 30

Mixing unit 30 comprises first mixing path 31 adjacent to developing unit 20, and second mixing path positioned behind first mixing path 31. First mixing path 31 and second mixing path 32 are separated by partition 33, and are connected via communicating paths 34 and 35 provided on both ends of said partition 33.

Bucket roller 36 is accommodated in first mixing path 31. Bucket roller 36 is driven by motor M2 so as to rotate in the arrow direction in FIG. 2.

Mixing screw 37 is provided in second mixing path 32. Mixing screw 37 is driven by the motor M2 as same as the bucket roller 36, so as to rotate in the arrow direction in FIG. 2.

Magnet support member 41 is fitted at a position near communicating path 35 of shaft 38 of mixing screw 37. Magnet support member 41 comprises two fan-shaped protrusions which protrude in mutually opposite directions encircling shaft 38, and magnets 45 and 46 are provide at the protruding ends of said two fan-shaped protrusions. Magnet support member 41 rotates on shaft 38 in conjunction with the rotation of mixing screw 37.

Detection plate 39 is mounted on the portion of shaft 38 protruding from the developing tank. Detection plate 39 rotates in conjunction with the rotation of mixing screw 37, so as to be detected by photointerrupter 40. The rotational positions of the aforesaid magnets 45 and 46 are detected by photointerrupter 40.

Developer density measuring sensor 50 (hereinafter referred to as "sensor 50") is provided at a position opposite magnet support member 41 on the back wall (the wall opposite partition 33) of second mixing path 32. Sensor 50 is arranged so as to confront transparent detection window 54 at a region at which magnets 45 and 46 pass in conjunction with the rotation of magnet support member 41. The construction of sensor 50 is described later.

(3) Replenishing unit 60

Replenishing unit 60 is positioned behind mixing unit 30, and is connected to second mixing path 32 via resupply aperture 61. Transport screw 62 is provided in replenishing unit 60. Transport screw 62 is driven by motor M3, so as to rotate in the arrow direction in FIG. 2. A toner hopper (not illustrated) is connected to replenishing unit 60 to supply toner from said hopper to replenishing unit 60.

(4) Sensor 50

Figure 3:
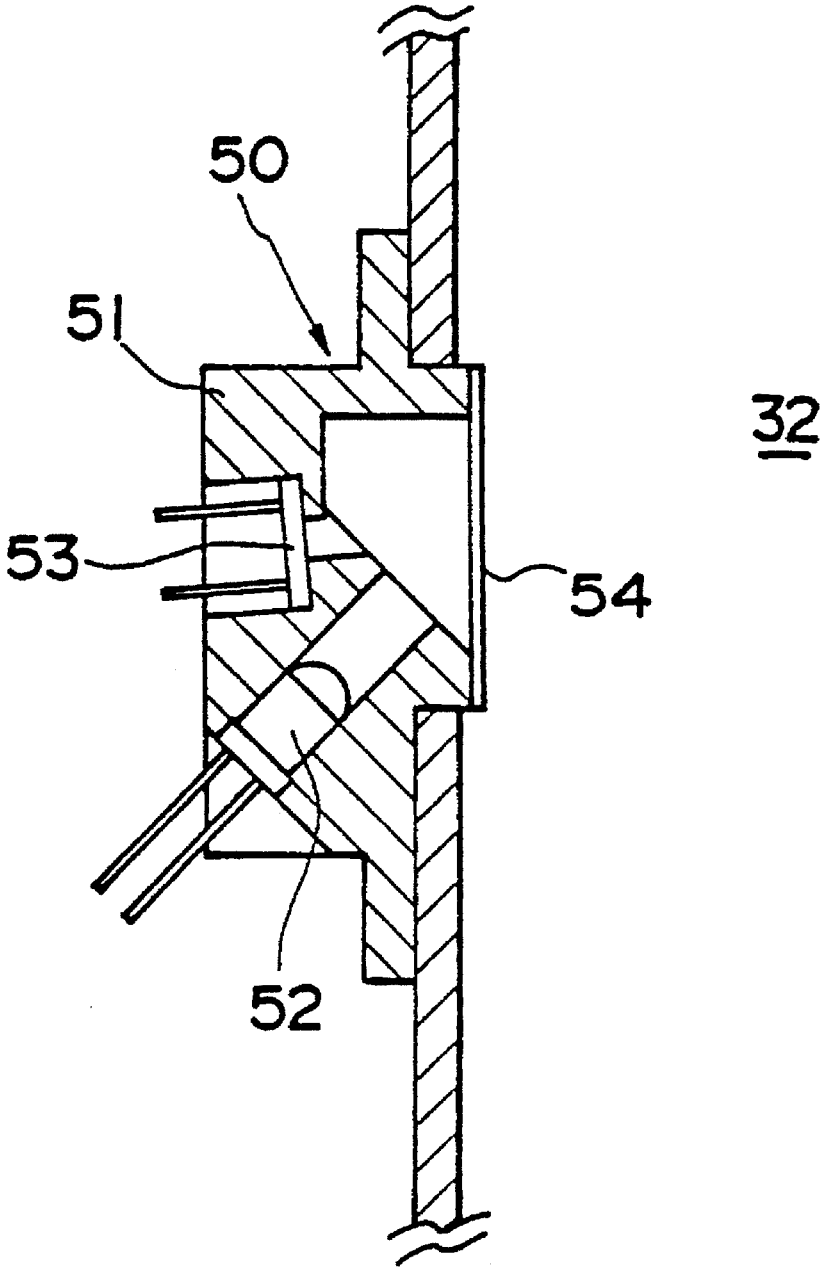
FIG. 3 is a section view of developer density measuring sensor 50.

FIG. 3 is a section view of sensor 50. Sensor 50 comprises housing 51, light emitter 52 and light receiver 53 anchored within housing 51, and transparent detection window 54 (hereinafter referred to as "detection window 54") covering light emitter 52 and light receiver 53. Sensor 50 is arranged such that detection window 54 is disposed on the rear wall of second mixing path 32 confronting the interior of the developing device, as previously described.

The surface of detection window 54 at least on the side confronting the interior of the developing device is formed of a material triboelectrically charged to the same polarity as the toner charge polarity, so as to prevent electrostatic adhesion of charged toner on the surface of detection window 54. Examples of such materials having a tendency for positive charging include glass, acrylic resin, acetate resin and the like; examples of such materials having a tendency for negative charging include fluororesin such as PFA, vinyl chloride resin, polyether sulfone and the like.

2) Operation (1) Developing

Mixing unit 30 accommodates developer comprising a toner and a carrier. When bucket roller 36 and mixing screw 37 start rotation, the developer in mixing unit 30 is mixed as it is transported, so as to circulate within mixing unit 30 on the route indicated by the arrow in FIG. 1. The toner and carrier are charged to mutually opposite polarities via the aforesaid mixing, and are circulated in this charged state.

A portion of the developer circulating in mixing unit 30 is supplied to the exterior surface of sleeve roller 21 via bucket roller 36 in first mixing path 31. The developer supplied to sleeve roller 21 is maintained on the exterior surface of said sleeve roller 21 via the magnetic force exerted by magnet roller 22, and is supplied toward photosensitive member 2 in conjunction with the rotation of sleeve roller 21. At a position confronting photosensitive member 2, the charged toner adheres to an electrostatic latent image formed on the surface of photosensitive member 2, thereby developing said latent image. At this time, the carrier is returned to mixing unit 30 along with the toner not supplied for developing, and the circulation is repeated.

(2) Density measurement

In the apparatus of the first embodiment, the density of the developer in the second mixing path 32 is measure using sensor 50. Sensor 50 illuminates the developer in second mixing path 32 via light emitter 52, the light reflected from the developer is received by light receiver 53, and a voltage signal corresponding to the amount of received light is output to CPU 100 (refer to FIG. 2). CPU 100 determines the density of the developer based on the output signal of sensor 50.

Density measurement is summarized below but details are omitted from the present discussion inasmuch as it is accomplished by well known sequences as described in U.S. Pat. No. 5,383,007.

A portion of the developer circulating in mixing unit 30 forms a magnetic brush maintained by magnets 45 and 46 in second mixing path 32. The magnetic brush alternatingly sweeps the surface of detection window 54 in conjunction with the rotation of magnet support member 41 (refer to FIG. 2).

In CPU 100, the output from sensor 50 is readout when the magnetic brush maintained by magnet 46 sweeps detection window 54, and developer density is determined by comparing said output with a predetermined threshold value. The thickness of the magnetic brush maintained by magnet 46 is normally constant, such that accurate density measurement is accomplished based on the light reflected from a normally constant amount of developer regardless of the amount of developer within second mixing path 32. Furthermore, the magnetic brush maintained by magnet 45 removes the electrostatic attraction of developer adhering to the surface of detection window 54, and is not used for developer density measurement.

CPU 100 determines insufficient density when the output of sensor 50 drops below the threshold value, and outputs instructions to resupply toner from the toner hopper to replenishment unit 60.

Toner resupplied for the toner hopper to toner replenishment unit 60 is transported by transport screw 62 and supplied from supply aperture 61 to second mixing path 32.

Sensor 50 may be mounted on developing unit 20, so as to measure the density of developer in developing unit 20.

3) Processing of detection window 54 and the other

Since the surface of detection window 54 is rubbed by developer circulating within the developing device, it is unavoidably subjected to damage. When the surface of detection window 54 becomes flowed by such rubbing, the window surface scatters the light reflected from the developer, and as developing is repeated, such flaws increase causing a reduction in the amount of reflected light received by the light receiver regardless of the actual developer density. As a result, the signal level output from sensor 50 to CPU 100 drops, and accurate developer density measurement cannot be achieved.

In the apparatus of the first embodiment, the surface of detection window 54 on the side confronting the interior of second mixing path 32 is processed to a roughness having a mean depth (Rp) of 50 μm. The 50 μm value is equal to the diameter of the carrier particles used in the apparatus of the first embodiment. The carrier particle size is rather larger than the toner particle size (toner particle size is generally 3~12 μm), and the carrier comprises about 90% of the developer. Thus, when the surface of detection window 54 is roughened under the aforesaid conditions, it resembles the state of a window surface damaged by rubbing of developer.

Figure 4A:
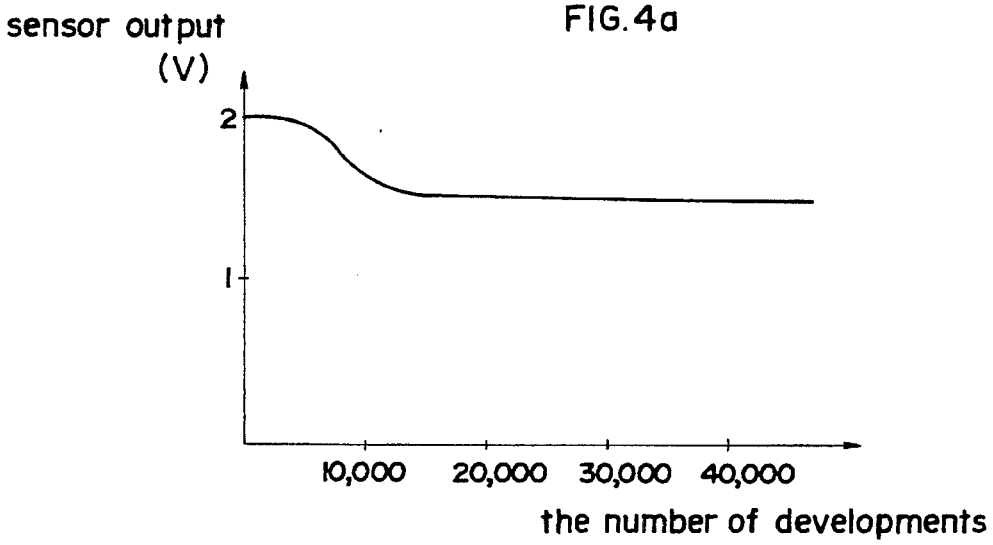
Figure 4B:
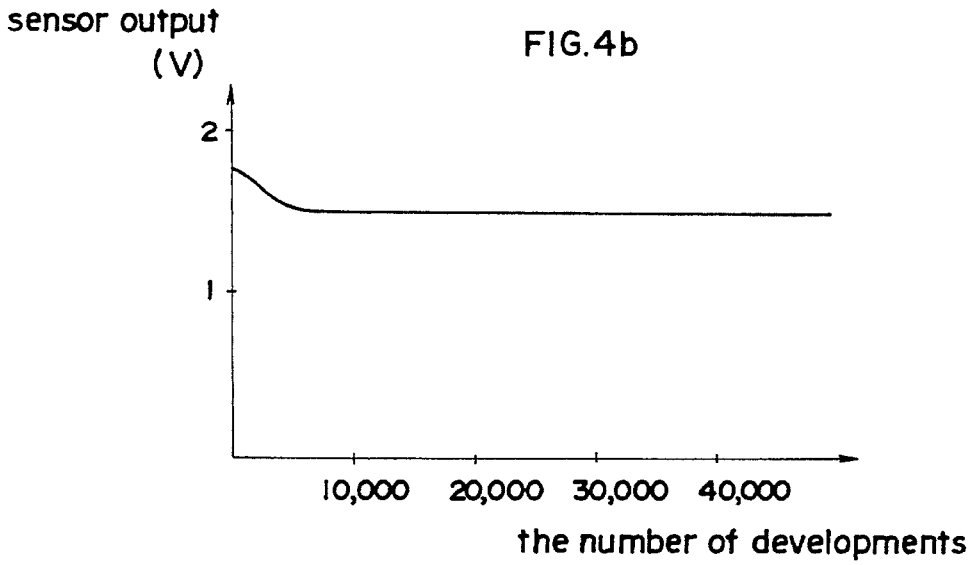
Figure 4C:
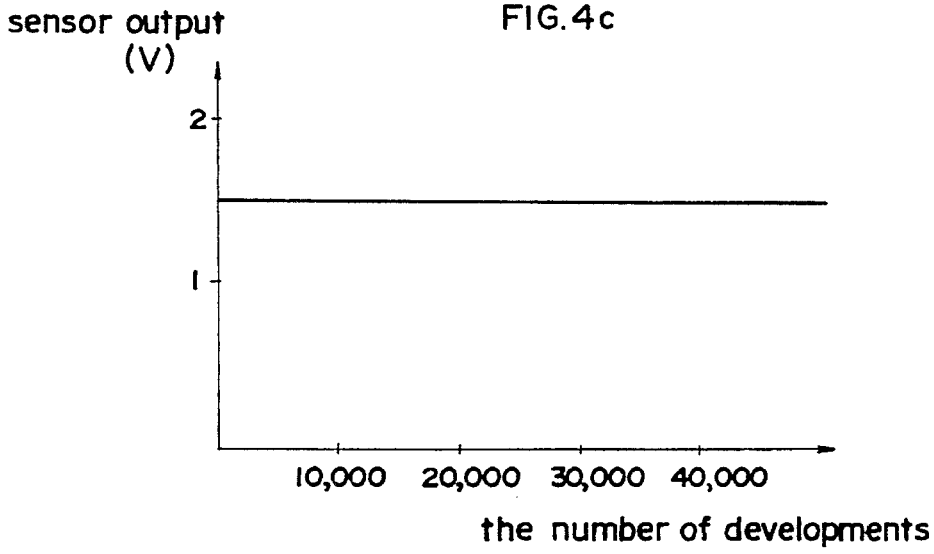

FIGS. 4*a* to 4*c* are graphs respectively showing the relationship between the number of developments and sensor output; the vertical axis expresses sensor output, and the horizontal axis expresses the number of developments. In the graphs of FIGS. 4*a* to 4*c*, developer density is normally constant.

FIG. 4*a* is a graph showing the change in output of a conventional sensor using a smooth flat-surfaced detection window. From this graph it can be understood that as the number of developments increases the window surface is increasingly damaged, precipitously decreasing sensor output from its initial level. The reduction of sensor output is putted on the brakes over 10,000 developments, after which sensor output stabilizes, because the damage to the window surface does not progress over a certain level.

FIG. 4*c* is a graph showing the change in output of sensor 50. Since the surface of detection window 54 is roughened in sensor 50 as previously described, the flawing condition of said surface is initially near that condition at which sensor output is stable, such that the change from the initial sensor output is slight and remains stable.

The surface of detection window 54 is randomly roughened to minimize the change in sensor output and stabilize the output. When compared to such randomly roughened surfaces, a surface roughened at regular spacing has room for new damage induced by developer rubbing on the surface of the detection window.

FIG. 4*b* is a graph showing the change in sensor output when the surface of the detection window is roughened at uniform spacing. Comparison of the graphs of FIGS. 4*b* and 4*c* discloses a slight drop from the initial sensor output in the case of a surface regularly roughened at uniform spacing.

Furthermore, in the case of a window surface regularly roughened at uniform spacing, the value of said spacing is about identical as the value of the mean depth (Rp) in the roughening, such that new damage is unlikely and fluctuation of sensor output is minimized.

The degree of roughening should be at maximum less than a mean depth of 80 μm because the common currently used carrier size is 30~80 μm.

FIG. 5 is a graph showing the relationship between developer density and sensor output. The vertical axis expresses sensor output, and the horizontal axis expresses developer density.

The solid line in the graph represents the output of a conventional sensor using a smooth flat-surfaced detection window, and the dashed line represents the output of sensor 50. The diagonal line region A represents the threshold value level for determining developer density when a conventional sensor is used in a developer density measuring apparatus. Diagonal line region B represents the threshold value level of the apparatus of the first embodiment using sensor 50.

As shown in the graphs, sensor 50 has reduced output at equivalent developer density compared to a conventional sensor using a smooth flat-surface detection window. This reduction is due to scattering of light reflected from the developer by the surface of a detection window processed by roughening.

Therefore, in the apparatus of the first embodiment, the threshold value for determining developer density is set lower than an apparatus using a conventional sensor. As can be understood from FIG. 5, although insufficient density is determined when developer density drops below 8% regardless of the apparatus, the lower limit of the threshold value is set relatively lower at 1.5 V in the apparatus of the first embodiment relative to the 2.0 V of an apparatus using a conventional sensor.

Of course, the level of the threshold value is not limited to the numerical values of the present embodiment.

Second Embodiment

A second embodiment of the invention is described hereinafter with reference to the accompanying drawings.

(1) Construction

FIG. 6 is a section view of developer density measuring sensor 70 (hereinafter referred to as "sensor 70") of the second embodiment.

Sensor 70 comprises housing 71, light emitter 72 and light receiver 73 attached within housing 71, and transparent detection window 74 (hereinafter referred to as "detection window 74") covering said light emitter 72 and light receiver 73.

Detection window 74 comprises a three-layer construction as shown in FIG. 7, i.e., transparent resin 75, conductive layer 76, and dielectric layer 77.

Conductive layer 76 is formed by vapor deposition of indium oxide on the surface of transparent resin 75. Bias voltage source 78 is connected to conductive layer 76, which supplies thereto a bias voltage Vw having a polarity identical to the polarity of the charged toner. The material of conductive layer 76 is not limited to indium oxide, and may also be a material such as titanium oxide, tin oxide and the like. Alternatively, a conductive film may be adhered to the surface of detection window 75 instead of the aforesaid coating.

Dielectric layer 77 is provided on conductive layer 76. Dielectric layer 77 is formed of polyethylene resin (PET), and is adhered to conductive surface 76 by, for example, a heat-hardening adhesive agent having light transmitting characteristics. Dielectric layer 77 may be formed of polyvinylidene fluoride or the like instead of PET, or a transparent glass may be used.

The construction of the developing device, CPU and the like is identical to those of the first embodiment. The connections and arrangements of sensor 70 with the aforesaid components is also identical to that of sensor 50 of the first embodiment.

2) Operation

The sequence of the developing operation and measuring developer density is identical to those of the first embodiment and further discussion is omitted.

When measuring the light reflect from the developer through a detection window as in the apparatus of the first and second embodiments, preventive measure must be devised relative to electrostatic adhesion of charged toner to the surface of the detection window.

When toner adheres to the detection window, most of the light from the light emitter is reflected by the adhered toner. Thus, the amount of reflected light received by the light receiver is not reduced even when developer density is actually reduced and the absolute amount of toner is insufficient, such that developer density cannot be accurately determined, and toner replenishment cannot be achieved.

In the apparatus of the second embodiment, toner adhesion on detection window 74 is prevented by a bias voltage application method. That is, when a developing operation starts, a bias voltage Vw is supplied from bias power source 78 to conductive layer 76 of detection window 74, and adhesion of the toner to detection window 74 is prevented by the repulsion action between the bias and the toner charge.

At this time, a disadvantage arises in conventional apparatus insofar as the conductive layer is scrapped off and the bias voltage is no longer suppliable due to the rubbing of the developer on the window surface because the conductive layer is only a coating on the surface of the detection window (transparent resin or the like).

Figure 8A:
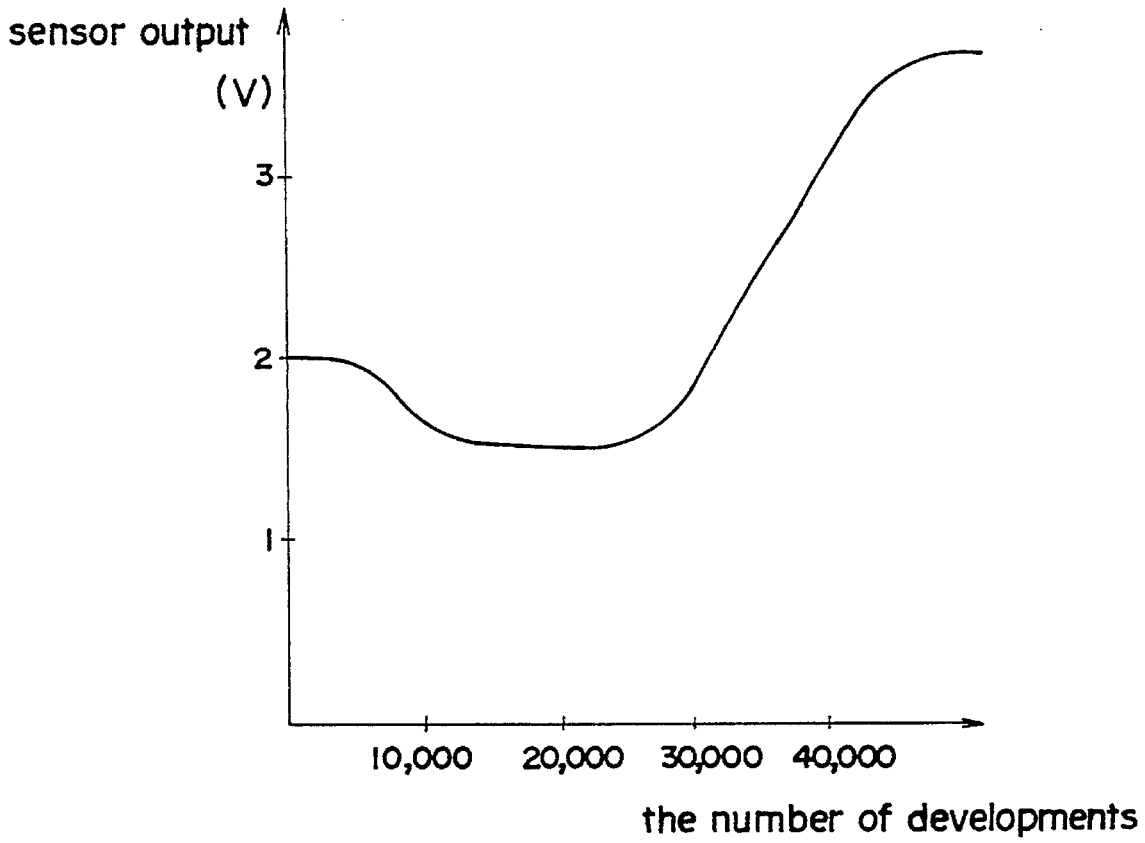
Figure 8B:
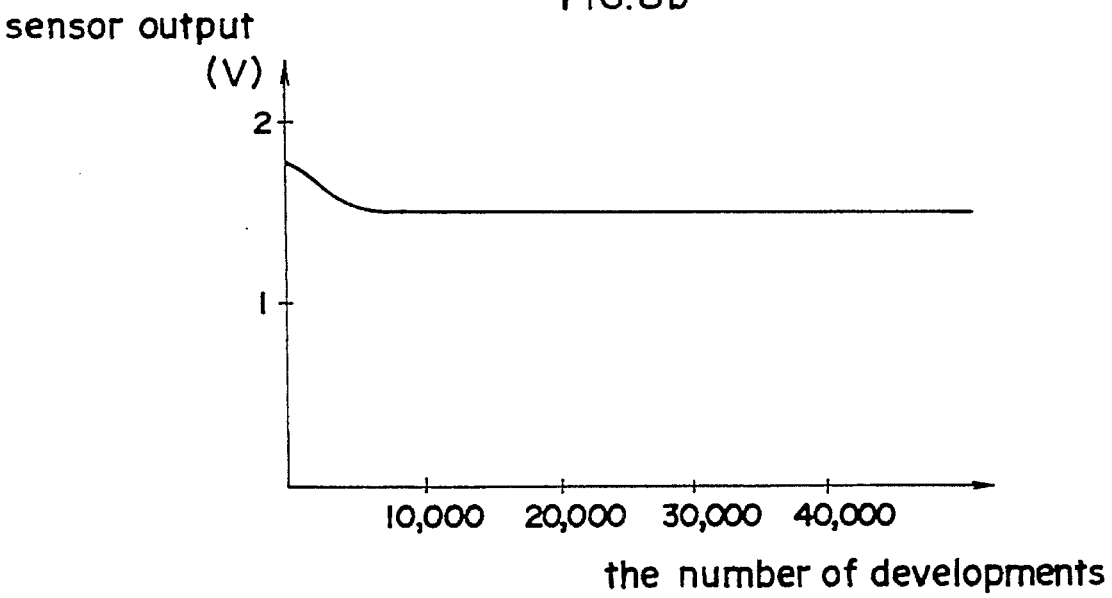

FIGS. 8*a* and 8*b* are graphs respectively showing the relationship between the number of developments and sensor output, such as the graphs of FIGS. 4*a* to 4*c*. The graph of FIG. 8*a* shows the change in sensor output of a conventional sensor using a detection window the surface of which is provided with a conductive layer coating. The graph of FIG. 8*b* shows the change in sensor output of sensor 70.

As shown in the graph of FIG. 8*a*, in a conventional sensor, when the number of developments exceeds a certain number, sensor output rises precipitously. This output rise is due to wear on the conductive layer of the detection window by the rubbing of the developer during repeated developments, which leads to the scraping off of said layer, and preventing the bias voltage from being supplied.

In contrast, in sensor 70, a dielectric layer 77 having a degree of hardness relatively higher than the conductive layer is provided on conductive layer 76, such that the conductive layer 76 does not become worn by the developer. Thus, stable and accurate density measurement is possible over a long term, as shown in the graph of FIG. 8*b*.

Even when dielectric layer 77 is provided over conductive layer 76, the function of preventing toner adhesion is not adversely affected because a charge having a polarity the same as the bias applied conductive layer 76 is realized by the dielectric polarization on the surface on the side opposite the conductive layer 76 of dielectric layer 77, i.e., on the surface confronting the interior of the developing device.

The drop in sensor output early stage number of developments seen in FIG. 8*b* is due to the scattering of light reflected from developer by the damage to the surface of the detection window due to rubbing of the developer (refer to FIG. 1). Thus, it is possible to accurately measure density with scant fluctuation of sensor output by subjecting the surface of dielectric layer 77 to a roughening process identical to that of detection window 54 of sensor 50 in the first embodiment.

According to the apparatus of the second embodiment, the replacement period of the conventional detection window requiring replacement periodically to due to wearing of the conductive layer is prolonged, and in some circumstances replacement is unnecessary, thereby reducing maintenance costs.

Although the present invention has been described with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. Developer density measuring apparatus comprising:

a transparent detection window confronting the interior of a developing device;

illumination means for illuminating developer comprising a toner and a carrier accommodated in said developing device; and density determining means for determining developer density by the amount of light reflected from said developer measured through said transparent detection window; and wherein the surface of the transparent detection window on the side confronting the interior of the developing device is roughened.

2. Developer density measuring apparatus as claimed in claim 1, wherein the surface of said transparent detection window is processed to a roughness having a mean depth (Rp) almost the same as the value of the carrier particles diameter accommodated in said developing device.

3. Developer density measuring apparatus as claimed in claim 1, wherein the surface of said transparent detection window is processed to a roughness having a mean depth (Rp) of the following range:

$$0<Rp\leqq 80\ \mu m.$$

4. Developer density measuring apparatus as claimed in claim 1, wherein the surface of said transparent detection window is randomly roughened.

5. Developer density measuring apparatus comprising:

a transparent detection window confronting the interior of a developing device;

illumination means for illuminating developer comprising a toner and a carrier accommodated in said developing device;

density determining means for determining developer density by the amount of light reflected from said developer measured through said transparent detection window;

electrically conductive layer provided on the surface of said transparent detection window on the side confronting the interior of the developing device; and bias supplying means to supply a bias voltage having the same polarity as the toner charge polarity to said electrically conductive layer; and wherein a dielectric layer is provided on the electrically conductive layer of said transparent detection window.

6. Developer density measuring apparatus as claimed in claim 5, wherein said dielectric layer has a degree of hardness relatively higher than said electrically conductive layer.

7. Developer density measuring apparatus as claimed in claim 5, wherein said dielectric layer is formed of polyethylene resin.

8. Developer density measuring apparatus as claimed in claim 5, wherein said dielectric layer is formed of polyvinylidene fluoride.

9. Developer density measuring apparatus as claimed in claim 5, wherein said dielectric layer is formed of a transparent glass.

10. Developer density measuring apparatus as claimed in claim 5, wherein the surface of said dielectric layer is roughened.

11. Developer density measuring apparatus comprising:

a transparent detection window confronting the interior of a developing device, the surface of which on the side confronting the interior of the developing device is roughened;

a light emitter which illuminates developer comprising a toner and a carrier accommodated in said developing device through said transparent detection window;

a light receiver which receives the light reflected from the developer through said transparent detection window; and microprocessor which determines developer density of the developer in the developing device by the amount of light received via said light receiver.

12. Developer density measuring apparatus comprising:

a transparent detection window confronting the interior of a developing device;

electrically conductive layer provided on the surface of said transparent detection window on the side confronting the interior of the developing device;

a bias supply circuit which supplies a bias voltage having the same polarity as the toner charge polarity to said electrically conductive layer;

a dielectric layer is provided on the electrically conductive layer of said transparent detection window;

a light emitter which illuminates developer comprising a toner and a carrier accommodated in said developing device through said transparent detection window;

a light receiver which receives the light reflected from the developer through said transparent detection window; and microprocessor which determines developer density of the developer in the developing device by the amount of light received via said light receiver.

13. A method for measuring developer density, which comprising the steps of:

illuminating developer comprising a toner and a carrier accommodated in a developing device through a transparent detection window, the surface of which on the side confronting the interior of the developing device is roughened;

measuring the amount of light reflected from said developer through said transparent detection window; and determining developer density in the developing device by said measured light amount.

* * * * *